United States Patent [19]

Neri et al.

[11] Patent Number: 4,962,771

[45] Date of Patent: Oct. 16, 1990

[54] FILTER ASSEMBLY MACHINE CIGARETTE SAMPLING UNIT

[75] Inventors: Armando Neri; Paolo Andreoli, both of Bologna, Italy

[73] Assignee: G.D. Società per Azioni, Bologna, Italy

[21] Appl. No.: 323,973

[22] Filed: Mar. 16, 1989

[30] Foreign Application Priority Data

Mar. 21, 1988 [IT] Italy ..... 3386 A/88

[51] Int. Cl.[5] ..... A24C 5/33

[52] U.S. Cl. ..... 131/282; 131/94; 131/908; 198/438; 73/863.91; 73/863.92

[58] Field of Search ..... 131/94, 282, 908; 73/863.91, 863.92; 198/370, 372, 438

[56] References Cited

U.S. PATENT DOCUMENTS 3,492,874 2/1970 Marradi ..... 73/863.91

4,484,591 11/1984 Wahle et al. ..... 131/908

4,574,646 3/1986 Mattei et al. ..... 73/863.92

4,825,994 5/1989 Gömann et al. ..... 198/438 X

*Primary Examiner*—V. Millin

*Assistant Examiner*—Joe H. Cheng

*Attorney, Agent, or Firm*—Marshall, O'Toole, Gerstein, Murray & Bicknell

[57] ABSTRACT

A unit for sampling cigarettes on a filter assembly machine, which unit is designed to cooperate with a conveyor for feeding the cigarettes through the filter assembly machine, and features a sampling conveyor tangent to the feed conveyor and having an even number of peripheral seats for the cigarettes; the aforementioned seats being arranged along the sampling conveyor, and each having a respective suction device; and a selecting device being provided for selectively activating the suction devices and so withdrawing given cigarettes off the feed conveyor.

8 Claims, 4 Drawing Sheets

FIG. 4
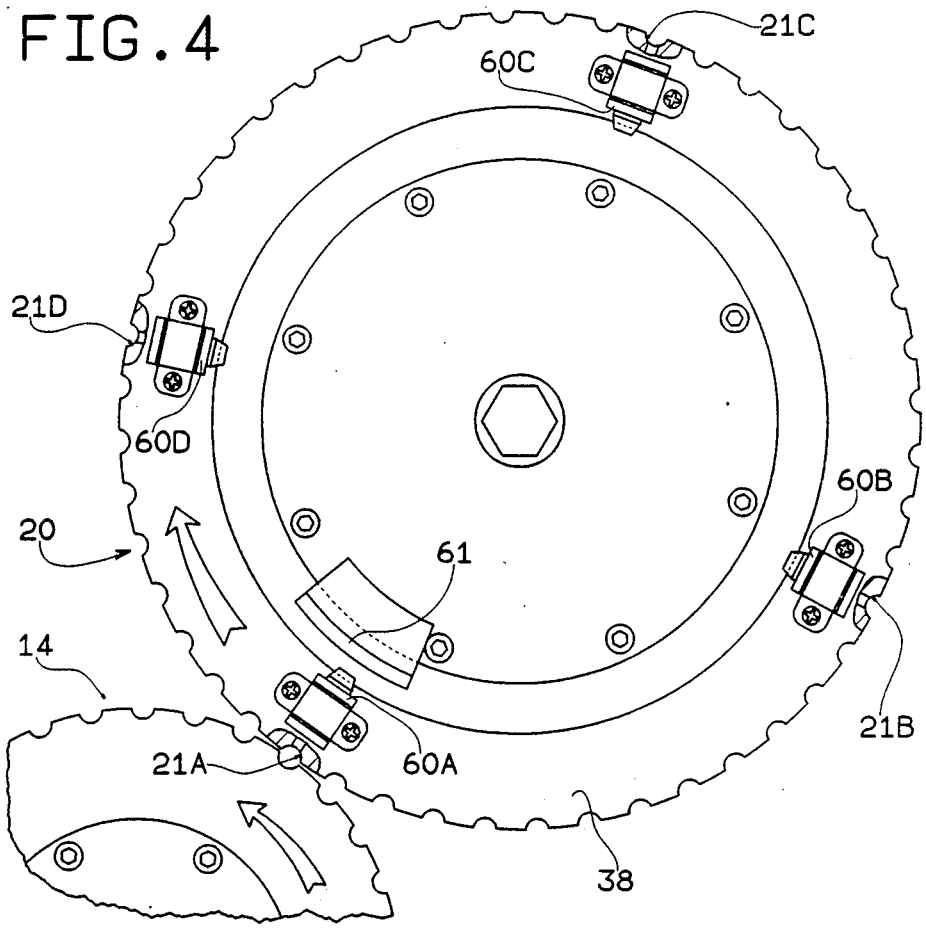
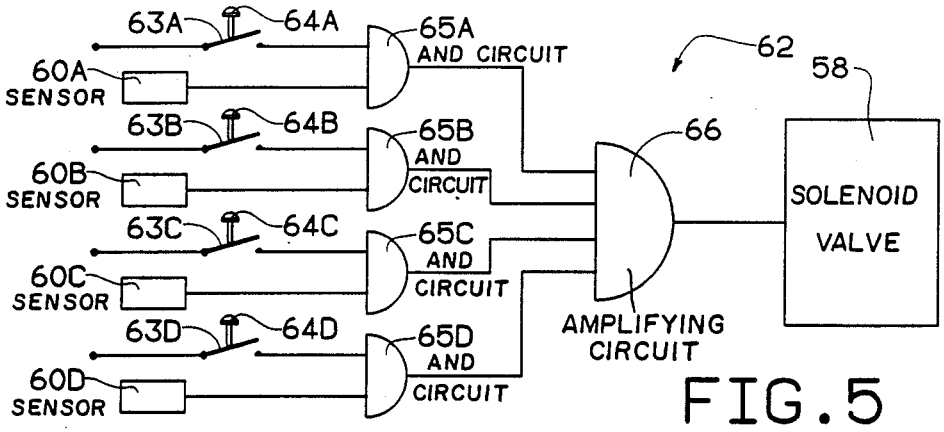
FIG. 5

FILTER ASSEMBLY MACHINE CIGARETTE SAMPLING UNIT

The present invention relates to a cigarette sampling unit for a filter assembly machine.

BACKGROUND OF THE INVENTION

A cigarette manufacturing machine normally supplies a filter assembly machine with a stream of cigarette rods having a length twice as long as the finished cigarette. Each cigarette length is cut in half on the filter assembly machine, usually by means of rotary cutters. The halves are then separated to provide a gap sufficient to accommodate a double filter. The two cigarette halves and the double filter are then joined by means of two strips to form a double cigarette wherein the two cigarette halves are joined by the filter. The double filter is then cut in half, usually by means of rotary cutters, to produce a stream of single cigarettes which are then fed to the output of the filter assembly machine and fed to subsequent manufacturing machinery.

At the output of the filter assembly machine, sample cigarettes are usually withdrawn for inspection. The operating parameters of both the manufacturing and filter assembly machines are appropriately adjusted according to the outcome of the inspection.

Such inspection usually consists of inspecting the geometry of the cigarettes, in particular the length of the filter and relative cigarette portions, etc. Any discrepancy between the inspected cigarettes and set operating data is interpreted by the operators who then make appropriate adjustments, for example, of the manufacturing and filter assembly machine cutters, printing devices, etc. In this connection, it is important to bear in mind that correct interpretation of the inspection data depends on knowing the precise position of each individual cigarette subsequent to its being withdrawn from the manufacturing machine. For example, if the tobacco-filled portion is shorter than it should be, the position of the double cigarette lengths in relation to the cutters can only be corrected by trial and error if the precise position occupied beforehand by the sample cigarette in relation to the cutters is not known. In the case of double cigarette lengths produced on a standard manufacturing machine, each double cigarette is cut into two halves, one each to the right and left of the cutter, thus resulting in the formation of two distinct groups. For inspection data to be interpreted correctly, it is essential that one know to which group the sample cigarette belongs.

This is even more of a problem in the case of a dual rod cigarette manufacturing machine, which gives rise to no less than four distinct groups or types (two for each rod).

SUMMARY OF THE INVENTION

An object of the present invention is to provide a cigarette sampling unit enabling selective withdrawal of cigarettes belonging to any given group or type of single cigarettes from a given location on a filter assembly machine.

With this object in mind, according to the present invention there is provided a filter assembly machine cigarette sampling unit designed to cooperate with a conveyor for feeding the cigarettes through the filter assembly machine, the sampling unit comprising a sampling conveyor located, in use, tangent to the feed conveyor and having a given number of peripheral seats for the cigarettes, the seats being equally spaced apart along the sampling conveyor, and each seat having a respective suction means, with a selecting device being provided for selectively activating said suction means for withdrawing given cigarettes from the feed conveyor.

BRIEF DESCRIPTION OF THE DRAWINGS

A non-limiting embodiment of the present invention will be described by way of example with reference to the accompanying drawings, in which:

FIG. 4 is a schematic view of a detecting device on the sampling unit shown in FIGS. 2 and 3; and FIG. 5 is a schematic view of a control circuit connected to the detecting device shown in FIG. 4.

DETAILED DESCRIPTION OF THE DRAWINGS

Figure 1:
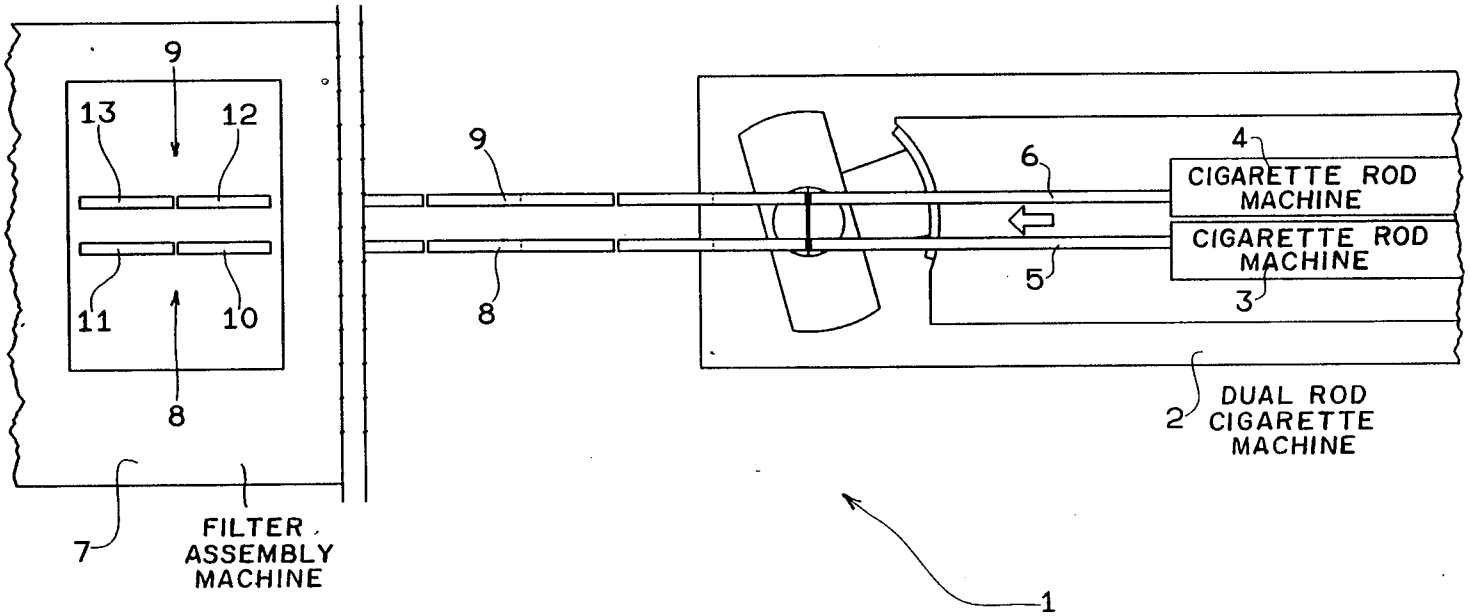
FIG. 1 is a schematic view of a filter cigarette manufacturing line.

With reference to FIG. 1 a cigarette manufacturing line 1 comprises a dual rod cigarette machine 2 of the type featuring two parallel lines 3 and 4 for producing respective cigarette rods 5 and 6. Manufacturing line 1 also comprises a filter assembly machine 7, the input of which is connected to the output of machine 2, and it is supplied with cigarette lengths 8 and 9 which are twice as long as the finished filter cigarette. The pairs of cigarette lengths 8 and 9 on filter assembly machine 7 are fed successively into respective seats (not shown) formed on a roller (not shown) inside machine 7, and are cut respectively into halves 10, 11 and 12, 13.

Figure 2:
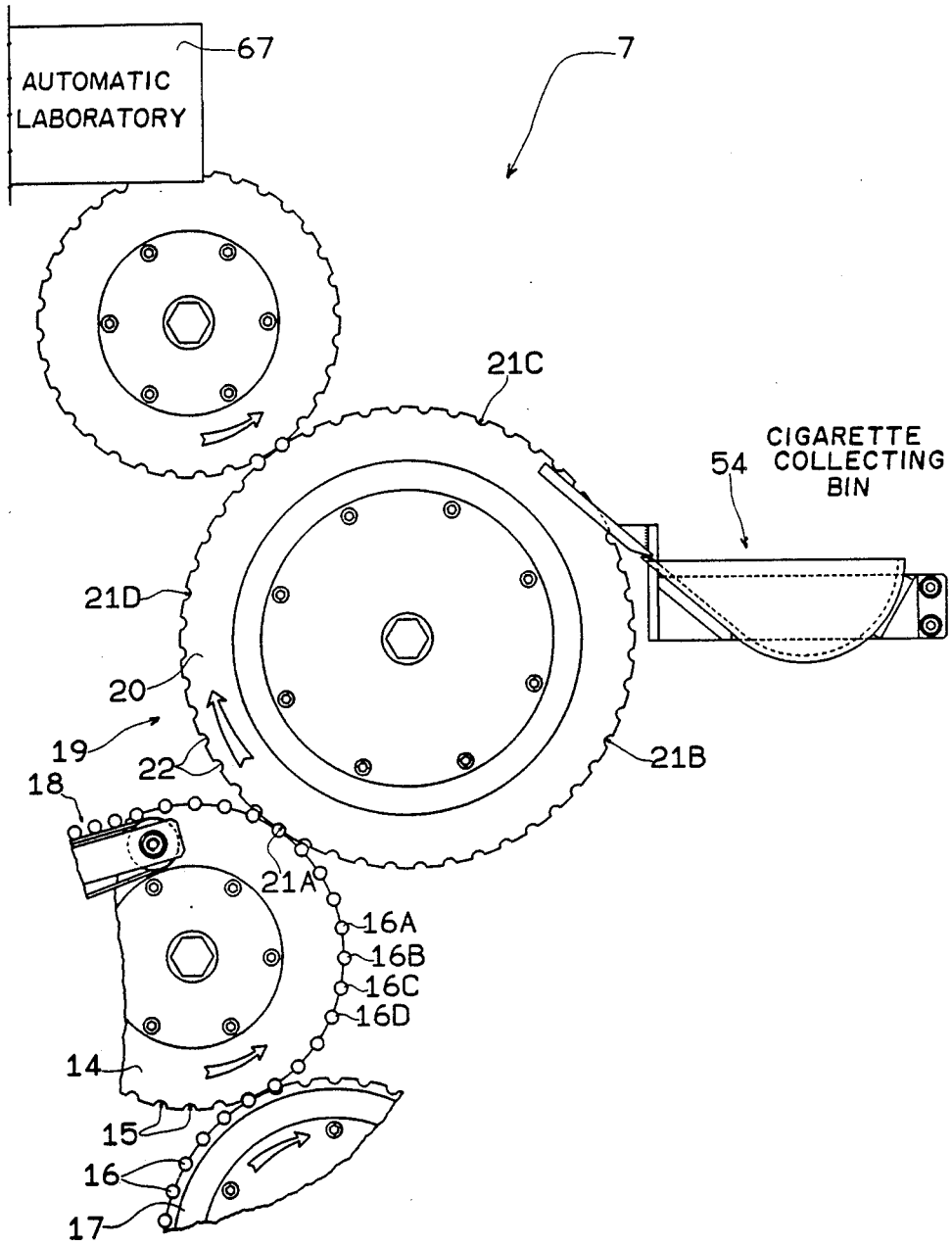
FIG. 2 is a side view of a detail on the output portion of the filter assembly machine shown in FIG. 1 and illustrating a sampling unit in accordance with the present invention.

As shown in FIG. 2, machine 7 presents an output portion wherein cigarettes 16 are fed successively off a tangent feed roller 17 into a number of equally-spaced peripheral seats 15 on a further feed roller 14 and from there are fed to a known type of output unit 18.

In FIG. 2, cigarettes 16 are numbered 16A, 16B, 16C and 16D to indicate halves 10, 11, 12 and 13 respectively. For reliably determining the type of cigarette 16 at all times, seats 15 and the respective seats formed on all the machine 7 rollers (not shown) upstream from roller 17 are appropriately used in multiples of four so that each seat 15 always receives the same type of cigarette 16.

Roller 14 is assigned a sampling unit 19 comprising a sampling conveyor roller 20 tangent to and turning about its axis at the same surface speed as roller 14. Roller 20 presents a number of peripheral axial grooves, four of which equally spaced about roller 20 constitute sampling seats 21A, 21B, 21C and 21D for respective cigarettes 16A, 16B, 16C and 16D, with the remaining grooves acting as counterseats 22 for enabling safe passage of cigarettes 16 between rollers 14 and 20. In this case also, the number of counterseats 22 between each pair of adjacent seats 21 is such that each seat 21 is always engaged by the same type of cigarette 16.

Figure 3:
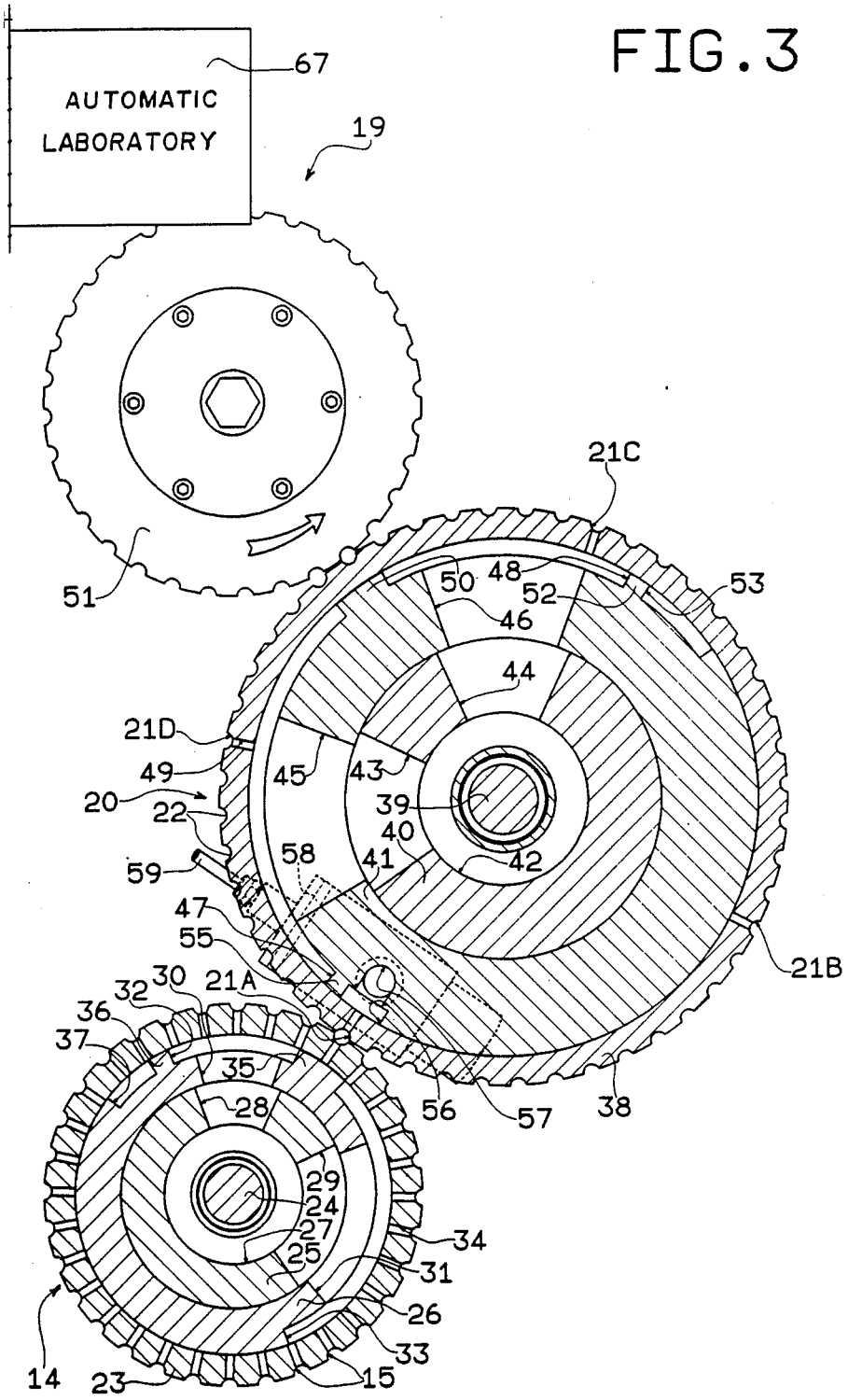
FIG. 3 is a sectional view of the sampling unit shown in FIG. 2.

As shown in FIG. 3, roller 14 comprises a rotary outer ring 23 having seats 15 and turned (counterclockwise in FIGS. 2 and 3) by a center shaft 24 supporting two fixed cylindrical distributors 25 and 26. Distributor 25 is fitted inside 26 and communicates with a suction device (not shown) via center passage 27.

Through distributor 25, there are formed two radial slots 28 and 29 communicating, on one side, with center passage 27 and, on the other, with two respective radial passages 30 and 31 in turn communicating with respective outer chambers 32 and 33 defined between the outer edge of distributor 26 and the inner edge of ring 23. The two chambers 32 and 33 communicate with seats 15 via radial channels 34 formed through ring 23, and they are separated by a dividing wall 35 the outer edge of which slides substantially thereby contacting the inner surface of ring 23. The dividing wall 35 is located at the point of tangency between rollers 14 and 20 so as to successively cut off communication between each seat 15 and center passage 27 as each seat 15 moves through the point of tangency between rollers 14 and 20.

A further dividing wall 36, similar to wall 35, separates chamber 32 from a further chamber 37, which is completely isolated from center passage 27 and located at the point of contact between roller 14 and output unit 18 for eliminating the vacuum inside channels 34. As shown in FIG. 3, roller 20 comprises a rotary outer ring 38 having seats 21 and counterseats 22, and turned (clockwise in FIGS. 2 and 3) by a center shaft 38 supporting two fixed cylindrical distributors 40 and 41. Distributor 40 is fitted inside 41 and communicates with a suction device (not shown) via a center passage 42.

Through distributor 40, there are formed two radial slots 43 and 44 communicating, on one side, with center passage 42 and, on the other side, with two respective radial passages 45 and 46 in turn communicating with respective outer chambers 47 and 48 defined between the outer edge of distributor 41 and the inner edge of ring 38. The two chambers 47 and 48 communicate with seats 21 via suction means consisting of radial channels 49 formed through ring 38, and these two chambers are separated by a dividing wall 50 the outer edge of which slides substantially and contacts the inner surface of ring 38. Dividing wall 50 is located at the point of tangency between roller 20 and a transfer roller or conveyor 51 forming part of sampling unit 19 and having substantially the same internal structure as rollers 14 and 20. Dividing wall 50 is designed to successively cut off communication between each seat 21 and center passage 42 as each seat 21 passes through the point of tangency between rollers 20 and 51.

A further dividing wall 52, similar to 50, separates chamber 48 from a further chamber 53, which is completely isolated from center passage 42 and located at the point of contact between roller 20 and a collecting bin 54 forming part of sampling unit 19 and designed to receive cigarettes 16 fed off roller 20 and not withdrawn by roller 51 (FIG. 2).

A further dividing wall 55, similar to 50, separates chamber 47 from a further chamber 56, which is completely isolated from center passage 42 and located at the point of tangency between rollers 20 and 14. Via an axial duct 57 formed through distributor 41 and a solenoid valve 58 also referred to as a selecting device, chamber 56 communicates with a suction duct 59 communicating with a suction device (not shown).

As shown in FIG. 4, each seat 21A, 21B, 21C and 21D is assigned a respective, e.g. inductive, sensor or detecting means 60A, 60B, 60C and 60D integral with ring 38 and traveling with the same about a circular trajectory, a portion of which, at the point of tangency between rollers 14 and 20, is subjected to signal emitting means comprising a fixed block 61 consisting, for example, of a metal element.

Sensors 60 form part of a control circuit 62 (FIG. 5) whereby each of sensors 60A, 60B, 60C and 60D is assigned a respective signal emitter or switch 63A, 63B, 63C and 63D operated manually by means of a respective button 64A, 64B, 64C and 64D and connected parallel with respective sensor 60 to a respective AND circuit 65A, 65B, 65C and 65D controlling operation of solenoid valve 58 via an amplifying circuit 66.

In actual use, cigarettes 16 are fed successively by roller 14 on to output unit 18, if none of buttons 64 is operated. As each seat 15 travels past dividing wall 35, the suction through the seat is substantially eliminated to enable withdrawal of a respective cigarette 16 by roller 20. Such withdrawal is of course only possible when said seat 15 mates with a corresponding seat 21.

As rollers 14 and 20 turn, control circuit 62 is supplied with a series of signals emitted by sensors 60 as seats 21 assigned respectively to the same travel over an arc spanning the point of tangency between rollers 14 and 20. The signals in themselves are totally ineffective by virtue of the presence of AND circuit 65.

For inspecting 16A type cigarettes, for example, the operator presses button 64A until the relative sensor 60A reaches the beginning of said signal emitting arc spanning the point of tangency between rollers 14 and 20. At said arc, sensor 60A emits a signal which, added to a signal emitted by operating button 64A, opens circuit 65A and operates solenoid valve 58. Consequently, when seat 21A reaches said point of tangency, the vacuum determined in seat 21A by the opening of solenoid valve 58 enables roller 20 to withdraw a cigarette 16A from respective seat 15.

The cigarette 16A so withdrawn may be fed by the operator on to roller 51 and, from this, to an automatic laboratory 67 or a collecting bin 54. In the case of the latter, the operator disables suction through the seats on roller 51 in known manner, thus enabling cigarettes 16 on roller 20 to continue towards bin 54.

By means of buttons 64, the operator may therefore withdraw a specific type of cigarette 16, inspection of which provides for immediate, accurate adjustment of the operating parameters of both filter assembly machine 7 and manufacturing machine 2.

We claim:

1. In a filter assembly machine (7), a cigarette sampling unit for withdrawing cigarettes (16) of predetermined types off a line (17, 14, 18) extending through said machine (7) to advance in succession a predetermined number of types (16A, 16B, 16C, 16D) of cigarette (16) there along, the sampling unit being off said line (17, 14, 18), and being designed to cooperate with a cigarette feed conveyor (14) in the line (17, 14, 18), and comprising a sampling conveyor (20), which is located, in use, tangent to said feed conveyor (14), and which is provided with peripheral seats (21) for accommodating the cigarettes (16); at least one of said slats (21) being selected to provide with respective selectively operable suction means (49), the seats (21) being equal in number to the cigarette types (16A, 16B, 16C, 16D) or to a multiple thereof, and a selecting device (58) being provided for selectively activating said suction means (49) for selectively withdrawing cigarettes (16) of given types (16A, 16B, 16C, 16D) off of the feed conveyor (14).

2. A cigarette sampling unit as claimed in claim 1 characterized by the fact that the selecting device comprises a valve (58) designed to open for selectively enabling said suction means (49) of each of said selected seats (21) on the sampling conveyor (20) to communicate with a suction source, and control means (62) for selectively opening the valve (58) as one of said selected seats (21) travels through the point of tangency between the feed and sampling conveyors (14, 20).

3. A cigarette sampling unit as claimed in claim 2 characterized by the fact that the control means (62) comprises fixed signal emitting means (61) located at the point of tangency between the feed and the sampling conveyors (14, 20) and, for each of said selected seats (21) on the sampling conveyor (20) a detecting means (60) for detecting the signal emitting means (61), each detecting means (60) traveling together with the sampling conveyor (20) along a given trajectory comprising a portion located at the point of tangency between the feed and sampling conveyors (14, 20) and being designed to emit a signal for detecting the fixed signal emitting means (61) as it travels along said portion of the trajectory.

4. A cigarette sampling unit as claimed in claim 3 characterized by the fact that the control means (62) also comprises a logic AND circuit (65) and a hand-operated signal emitter (63) connected to the respective said AND circuit (65) for opening the valve (58).

5. A cigarette sampling unit as claimed in claim 3 characterized by the fact that the fixed signal emitting means (61) comprises a metal block and each detecting means (60) is an inductive sensor.

6. A cigarette sampling unit as claimed in claim 1 characterized by the face that it also comprises a collecting bin (54) tangent to the sampling conveyor (20) and designed to receive said withdrawn cigarettes (16) of the given types.

7. A cigarette sampling unit as claimed in claim 1 characterized by the fact that is comprises an automatic laboratory (67) for inspecting the cigarettes (16) withdrawn by the sampling conveyor (20); and, a transfer conveyor (51) being provided between the laboratory (67) and the sampling conveyor (20) for transferring said withdrawn cigarettes to said laboratory.

8. A cigarette sampling unit as claimed in claim 1 characterized by the fact that the feed and sampling conveyors (14, 20, 51) are rollers.

* * * * *